US005769213A

United States Patent [19]

Chatterton

[11] Patent Number: 5,769,213

[45] Date of Patent: Jun. 23, 1998

[54] CARD WITH ARTICLE CARRIER

[76] Inventor: Philip Chatterton, 2360 Tallahassee St., Fort Lauderdale, Fla. 33326-2330

[21] Appl. No.: 810,600

[22] Filed: Feb. 28, 1997

Related U.S. Application Data

[63] Continuation of Ser. No. 664,742, Jun. 17, 1996, which is a continuation-in-part of Ser. No. 414,388, Mar. 31, 1995, abandoned.

[51] Int. Cl.[6] ..... A45C 15/00

[52] U.S. Cl. ..... 206/38; 206/449; 206/555; 206/564; 150/147; 15/435; 15/447; 40/611; 40/658; 40/666

[58] Field of Search ..... 150/147; 15/447, 15/435; 40/611, 658, 666; 206/371, 38, 39, 214, 425, 449, 555, 564

[56] References Cited

U.S. PATENT DOCUMENTS

| | | | |
|---|---|---|---|
| 59,618 | 11/1866 | Mahon | 206/39 |
| 3,287,841 | 11/1966 | Spragg et al. | 40/658 X |
| 4,450,955 | 5/1984 | Featherston | 150/147 X |
| 4,711,347 | 12/1987 | Drexler et al. | 150/147 X |
| 5,456,034 | 10/1995 | Lewis et al. | 40/666 |

*Primary Examiner*—Stephen Cronin
*Attorney, Agent, or Firm*—Robert M. Downey, P.A.

[57] ABSTRACT

A device for carrying an article such as a pen, pencil, eyeliner, nail file, flashlight, and the like, includes a flat, rigid base sized and configured to fit within a credit card slot of a wallet or purse so that a peripheral edge zone remains exposed exteriorly of the slot, and a receptacle formed along the peripheral edge zone of the base for releasably capturing the article thereon and defining a handle to facilitate removal of the device from the card slot.

14 Claims, 6 Drawing Sheets

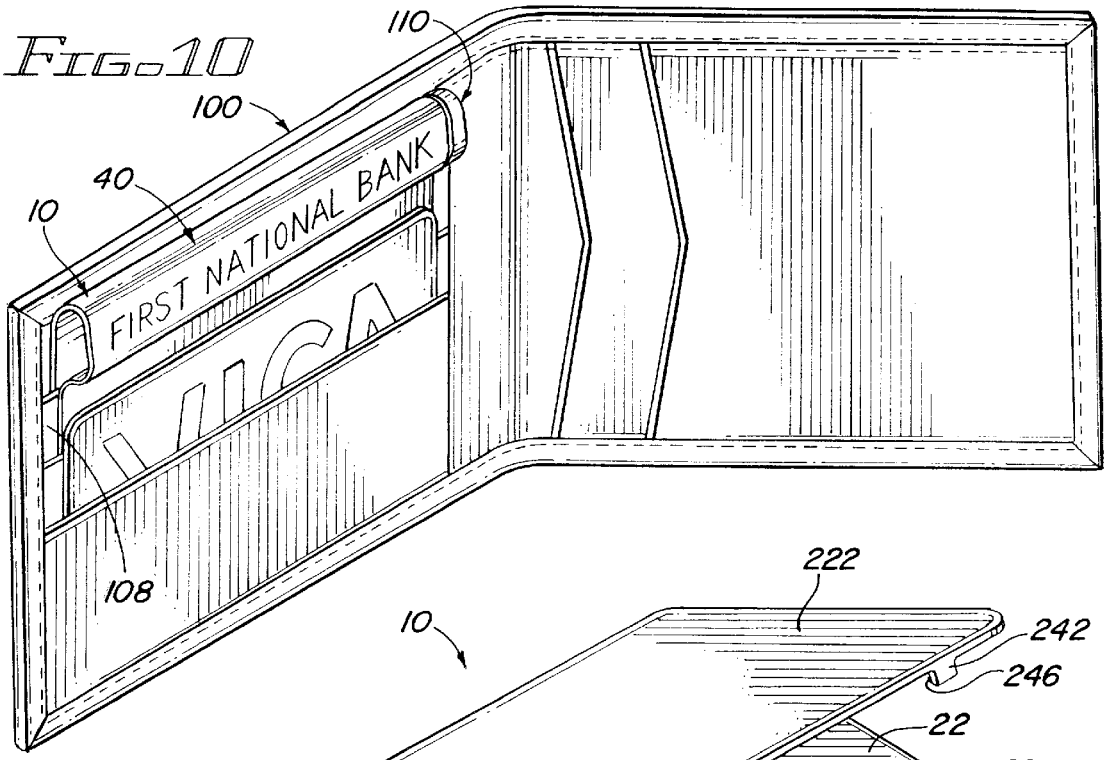
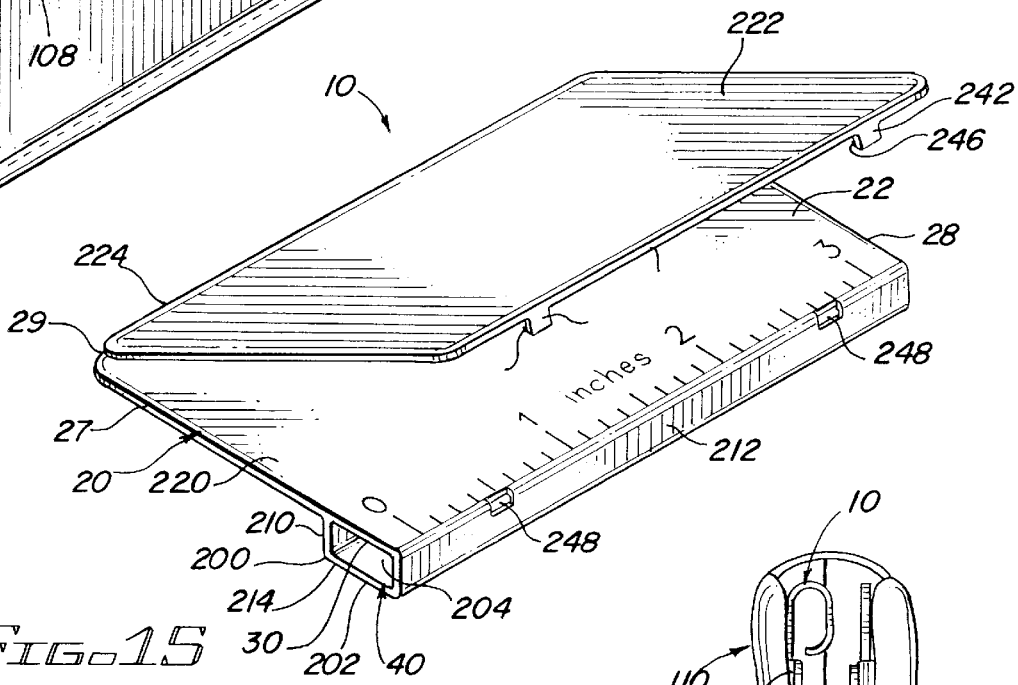
FIG. 15
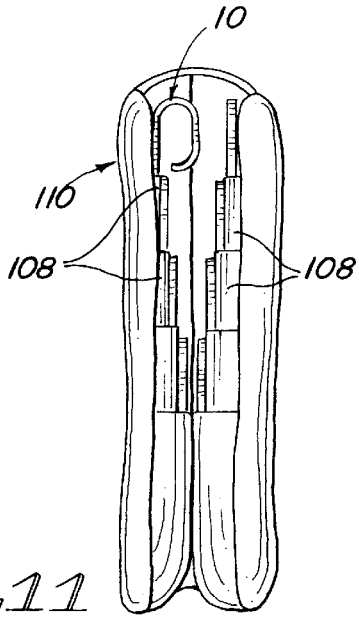
FIG. 11

CARD WITH ARTICLE CARRIER

BACKGROUND OF THE INVENTION

1. Field of the Invention

This application is a continuation application of co-pending patent application Ser. No. 08/664,742 filed on Jun. 17, 1996 which is a continuation-in-part application of patent application Ser. No. 08/414,388 filed on Mar. 31, 1995, now abandoned.

2. Field of the Invention

The present invention relates to a carrier device, and more particularly, to a rigid card with means for carrying an article such as, but not limited to, a pen, eyeliner pencil, nail file, flashlight, and the like, wherein the card is specifically sized and configured to be removably received within a credit card slot of a wallet or purse.

DESCRIPTION OF THE RELATED ART

Most people have a need to carry one or more articles on their person during their daily travels. Commonly carried articles, such as: writing implements (pens and pencils); cosmetic articles (lipstick, eyeliner pencils, perfume, mascara, nail files, tweezers, nail clippers, small brushes, etc.); small flashlights; pen knives; letter openers; and the like are routinely carried by men and women in pockets, handbags, carry cases, or other cumbersome carrying means which they might not otherwise wish to tote along with them on particular occasions. Often, small articles, such as those identified above, are lost when carried loosely in one's pocket or handbag. At other times, they are forgotten, particularly if they need to be collected and placed in one's pocket or handbag prior to leaving home and each time they are used.

Notwithstanding the foregoing, most men prefer to carry a wallet with them virtually at all times when they leave their home. Similarly, practically every woman carries a purse wherever they may go throughout the course of the day. The typical wallet or purse contains means for carrying paper currency and rigid plastic cards, such as credit cards. In most instances, the means for carrying such rigid plastic cards consists of an arrangement of spaced, parallel slots or pockets formed on the inside of one or more folding panels of the wallet or purse. This enables a person to carry a collection of credit cards, identification cards, membership cards, a driver's license, and the like in a tiered arrangement so that a top or side peripheral edge zone of each card is visible to the person when they open their wallet or purse. In this manner, the person can quickly locate and identify the particular card item they may need so that it can be readily removed from its slot or pocket for use.

This otherwise efficient arrangement of card slots in wallets or purses to hold a collection of plastic cards in a preferred orientation, as described above, creates an unused space or gap when the wallet or purse is closed. This space, which has not been previously intended for any particular use or purpose, is an inherent result of most wallet and purse designs, and provides for the opportunity to conveniently carry essential articles, as previously identified, in a wallet or purse.

In the past, various pocket size devices have been proposed for carrying articles therein. In particular, the U.S. Pat. No. 59,618, to Mahon, discloses an apparatus for carrying postage stamps, Internal Revenue stamps, railroad checks, and the like. The Mahon apparatus includes a cylinder or case which is intended to hold the stamps therein. The apparatus further includes a pair of spaced guide plates or feeders which extend tangent to the cylinder. The guide plates terminate together in straight edges or lips which act as cutters when the guide plates are compressed. In use, a scroll of stamps is inserted through the open end of the cylinder. The scroll or coil of stamps is contained loosely in the cylinder so that it can rotate and unroll as stamps are pulled and fed through a gap between the guide plates prior to exiting from between the lips. When the appropriate number of stamps have been withdrawn from between the guide plates, the lips are compressed together and the exposed stamps are torn from a remainder of the scroll. While the Mahon apparatus is useful as a dispenser for stamps, it is not structured to contain an article, such as a pen, in snug-fitted grasped relation within a receptacle so that the article remains stationary therein, and wherein retrieval of the article is limited to axial movement outwardly from an open end of the receptacle. Further, the Mahon apparatus is not structured or intended for receipt within a credit card pocket or slot in a wallet or a purse.

The U.S. Pat. No. 781,222, to Morse, discloses a device for displaying stamps or other articles, and includes two transparent sides or panels which are normally disposed in overlying relation. At least one of the panels is made convex, so that when the sides or panels are in overlying relation, they come together, pinching the stamp or other flat sheet article placed between them. The Morse device fails to provide a receptacle for axial receipt and axial retrieval of an article therein. More specifically, the Morse device fails to provide a card device sized and configured for receipt within a credit card pocket or slot in a wallet or purse, wherein the device includes a receptacle structured and configured for snug-fitted axial receipt of an article therein. Further, Morse fails to provide an article carrying receptacle that is structured to grasp an article in a stationary position therein so that the retrieval of the article is limited to outward axial movement relative to the receptacle.

Accordingly, there is an urgent need in the related art for a device structured to be removably received within the credit card slot of a typical wallet or purse, and which includes means for carrying articles such as a pen, pencil, cosmetic instrument or product, pen-light, and the like within the otherwise unused space which exists when a wallet or purse is folded closed.

SUMMARY OF THE INVENTION

The present invention relates to a device for carrying an article such as a pen, pencil, mascara container, eyeliner pencil, perfume container, nail file, flashlight, and the like in a wallet or purse. The device is preferably formed of a rigid plastic or like moldable material and is primarily characterized by a flat rigid card-like base having means formed along a peripheral edge zone for releasably capturing the article thereon. The base is sized and configured to duplicate the dimensions of a standard credit card so that it may be removably received and stored within a credit card slot in a wallet or purse. When the base is received within the slot, the peripheral edge zone of the base remains exposed exteriorly of the slot so that it is clearly visible when the wallet or purse is opened.

In several preferred embodiments, the article capturing means includes an elongate receptacle formed along the peripheral edge zone of the base, forming a raised rail which serves as a handle means for grasping the device in order to remove it from the credit card slot. The capturing means, which remains exposed when the device is carried in a wallet, provides an ideal means for advertising, either on the device itself or on the article, if visibly carried on the base.

With the foregoing in mind, it is an object of the present invention to provide a device for carrying an article which is structured to fit within a credit card slot or pocket in a wallet or purse so that the carried article occupies an otherwise empty space when the wallet or purse is closed.

It is another object of the present invention to provide a card device structured to fit within a credit card slot or pocket in a wallet or purse and which includes means for carrying several articles such as a writing implement and a credit card, phone card, debit card, writing pad, or the like.

It is a further object of the present invention to provide a rigid card device for carrying an article thereon and which includes a writing surface.

It is still another object of the present invention to provide a card device for carrying an article such as a writing implement and which further includes means for protectively carrying one or more sheets of paper.

It is yet a further object of the present invention to provide a card device for carrying an article which may be used for advertising or other promotional or informational purposes.

These and other objects and advantages of the present invention will become more readily apparent in the description which follows.

BRIEF DESCRIPTION OF THE DRAWINGS

For a fuller understanding of the nature of the present invention, reference should be had to the following detailed description taken in connection with the accompanying drawings in which:

FIG. 10 is a perspective view of the inside of an opened wallet showing the device of the present invention operatively inserted within a credit card slot of the wallet;

FIG. 11 is a side elevational view of a closed wallet, showing the device of the present invention operatively inserted and positioned within a credit card slot of the wallet, so that the article receptacle of the device occupies an otherwise empty space therein;

FIG. 15 is a bottom perspective view of an alternative to the seventh embodiment showing the upper and lower portions of the base in partially open position and latching means for securing the upper and lower portions in the stacked position.

Like reference numerals refer to like parts throughout the several views of the drawings.

DETAILED DESCRIPTION OF THE PREFERRED EMBODIMENTS

Figure 2:
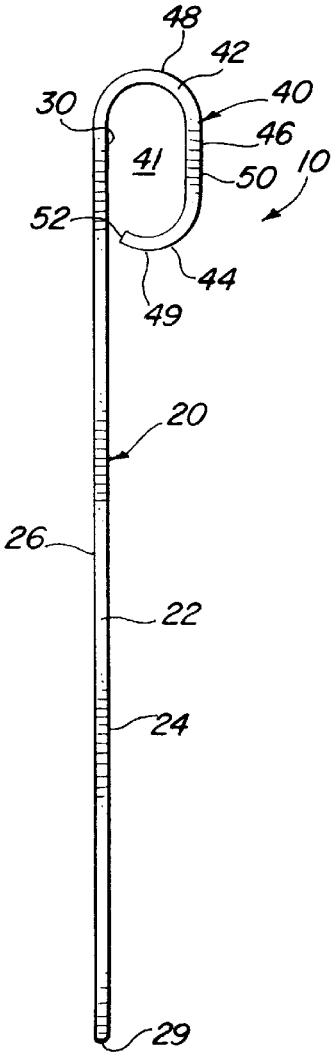
FIG. 2 is a side elevational view of the embodiment of FIG. 1.

Referring to the several views of the drawings, the present invention is shown in accordance with various preferred embodiments thereof and is generally indicated as 10.

Throughout the several views of the drawings, the device 10 is shown to include a base 20 formed of a rigid material such as plastic. The base 20 is sized and configured for removable receipt within the credit card sized pockets or slots of a typical wallet or purse and includes a primary panel 22 having a top surface 24, a bottom surface 26, opposite side edges 27, 28, a bottom edge 29, and a top peripheral edge zone 30 having an article receptacle 40 formed therealong. When the base is inserted within the credit card pockets or slots 108 of a wallet 100 or purse, as seen in FIGS. 10 and 11, the top peripheral edge zone 30 is exposed exteriorly of the pocket or slot so that it is clearly visible or easily recognized by touch.

Figure 1B:
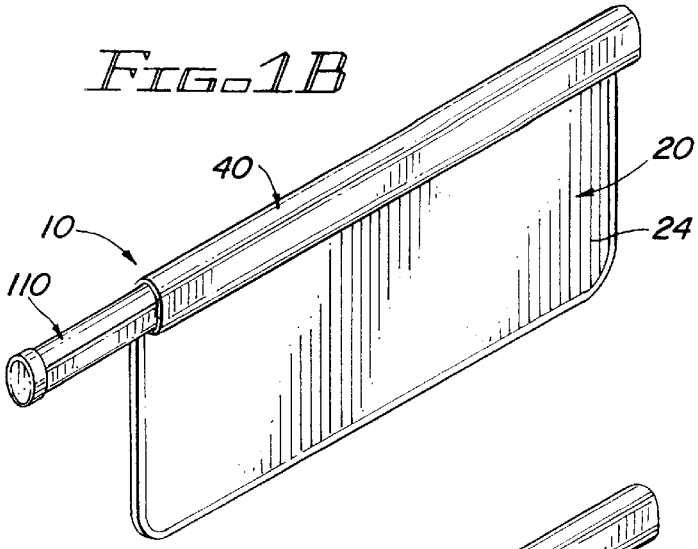
FIGS. 1A–1C show a top front perspective view of a first preferred embodiment of the card device of the present invention illustrating, in sequence, insertion of a pen into the article receptacle for storage therein.
Figure 1C:
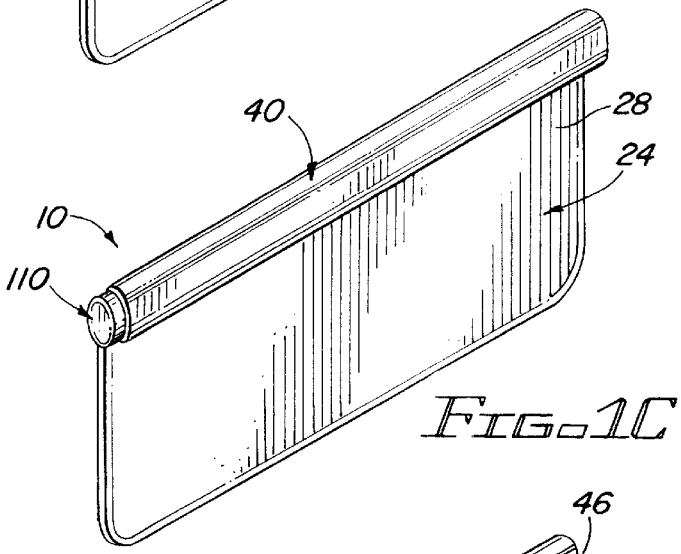
Figure 1A:
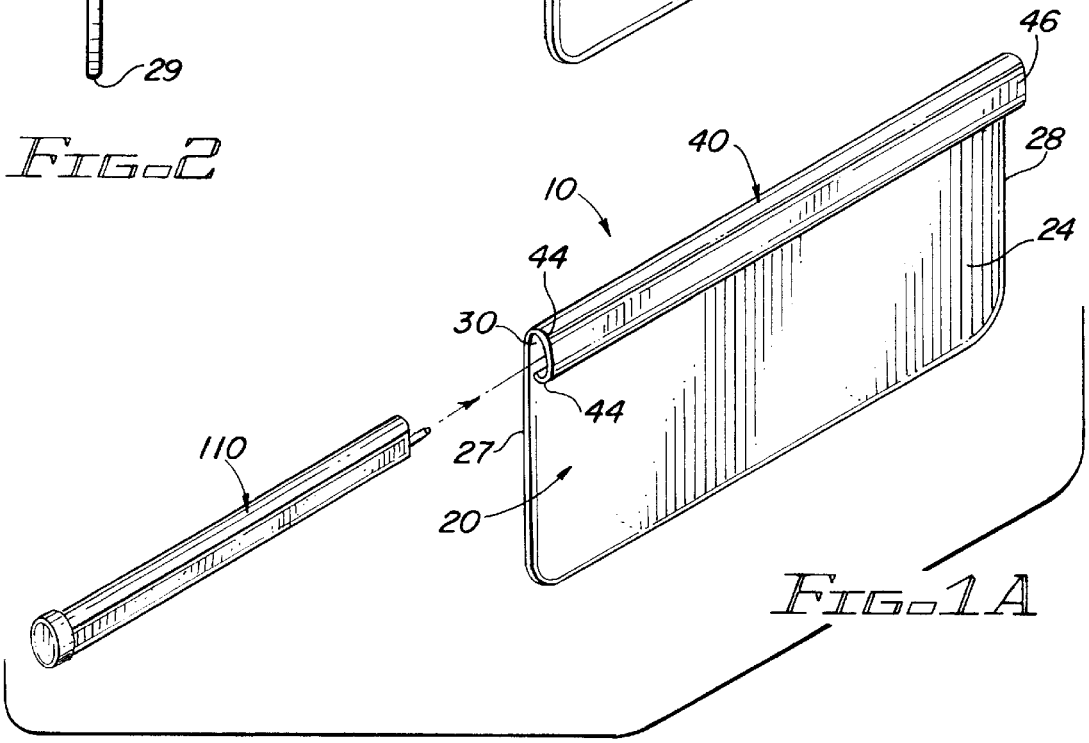

The article receptacle 40 is specifically structured to releasably capture an article 110 such as a pen, pencil, cosmetic instrument, flashlight, and the like, therein in a stowed position for subsequent retrieval as needed. FIGS. 1A–1C illustrate, in sequence, the insertion of an article 110, such as a pen, within the receptacle 40.

In a first preferred embodiment, the article receptacle 40 includes a hollow elongate channel 41 formed by a wall structure 42 extending along the top peripheral edge zone 30. The wall structure 42 is characterized by a curl-over lip 44 forming an elongate, raised rail 46 along the top peripheral edge zone 30 (or alternatively, along a side peripheral edge) of the base 20, and includes a rounded top longitudinal surface 48, a rounded bottom longitudinal surface 49, and a front face 50. The raised rail structure 46 provides a handle means for grasping the device 10 and pulling the base 20 out of the credit card slot or pocket 108 of the wallet or purse 100. The curl-over lip 44 terminates at a free edge 52 in close, spaced relation to the top surface 24 of the base 20. This allows the receptacle wall structure 42 to yield to the force of expansion exerted by an article 110 that is inserted into the channel 41, causing the free edge 52 to be pried away from the top surface 24, effectively expanding the size of the interior channel 41. The receptacle wall 42 maintains pressure on the article 110 in the channel 41 due to a flexible memory of the curl-over lip 44 which urges the free edge 52 towards the top surface 24 of the base 20. This serves as a holding means for releasably grasping and securing the article 110 within the channel 41 of the receptacle 40 so that the article is held stationary in a stowed position therein. Retrieval of the article from the stowed position is limited to axial outward movement upon applying a pulling force on the article. The front face 50 of the curl-over lip 44 provides an ideal surface for placing advertising, information, designs or other indicia thereon which will remain visible when the device 10 is carried in the slots of pockets 108 of a wallet or purse 100.

Referring to FIGS. 3–6, there is illustrated further embodiments of the present invention, incorporating the structural elements described above and further including a rigid back panel 60 integrally formed with the primary panel 22 along a fold 62. The back panel 60, together with the primary panel 22 and fold 62 define the base 20. The fold 62 is a type of self-hinge serving as a biasing means to urge the panels 22, 60 towards one another in generally coplanar relation.

The back panel 60 includes an inner facing surface 64 disposed in opposing relation to the bottom surface 26 of the primary panel 22, and an outer facing surface 66. A gap 69 is created between a top longitudinal edge 68 of the back panel 60 and the top surface 48 of the receptacle to allow grasping of the top edge 68 for prying the back panel away from the primary panel 22. This enables a flat article 120, such as a credit card or stack of papers, to be placed or removed from a stowed, captured position between the panels 60, 22. Upon releasing the top edge 68, the hinge fold 62 causes the panels 60, 22 to spring back towards each other, to a relaxed position, effectively capturing an article placed therebetween. The gap 69 also serves to guide a credit card or sheet(s) of paper between the two panels 60, 22.

Figure 3:
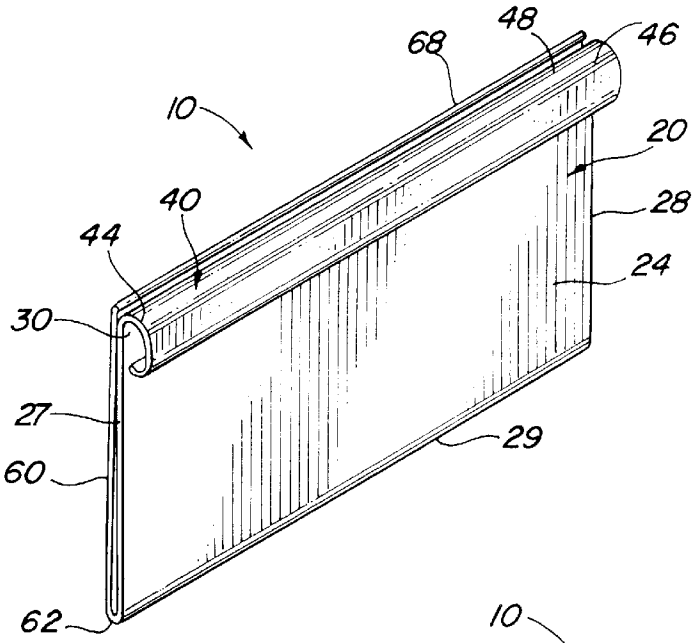
FIG. 3 is a top front perspective view of a second preferred embodiment of the card device of the present invention.
Figure 4:
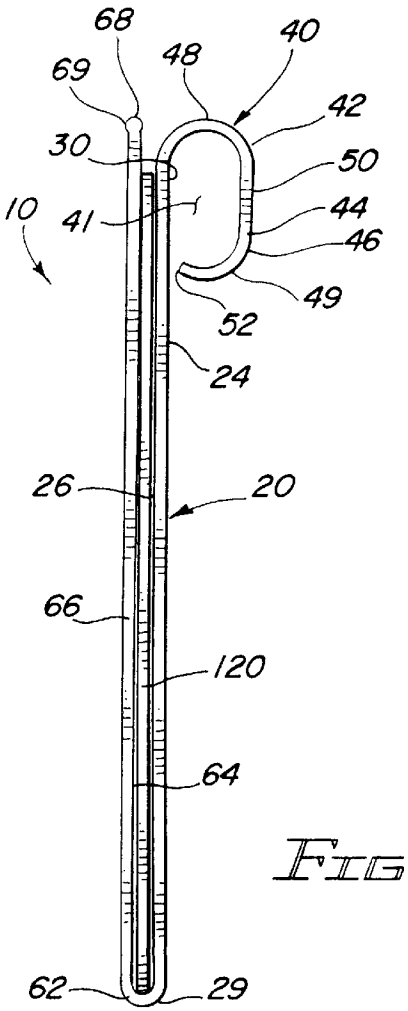
FIG. 4 is a side elevational view of the embodiment of FIG. 3, showing a writing pad, card, or the like, received between the panels of the device.

In the embodiment shown in FIGS. 3 and 4, the top edge 68 is generally parallel with the top surface 48 of the wall structure 42 so that the back panel 60 substantially covers the bottom surface 26 of the primary panel 22. This particular embodiment is ideal for protectively capturing one or more sheets of paper, such as a thin note pad, between the panels 60, 22; allowing the base 20 to be inserted and withdrawn from the credit card slot or pocket without damaging the edges or corners of the paper sheets.

Figure 5:
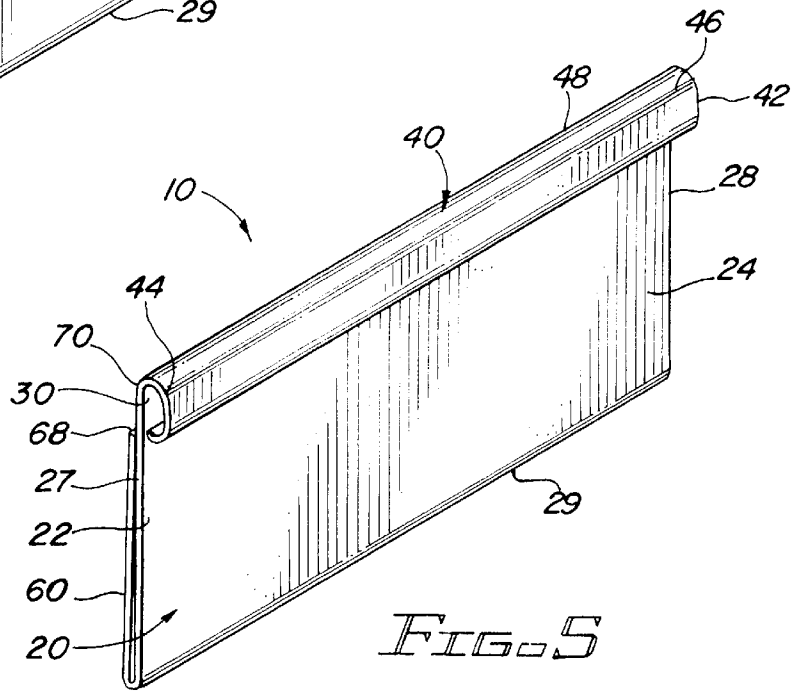
FIG. 5 is a top front perspective view of a third preferred embodiment of the present invention.
Figure 6:
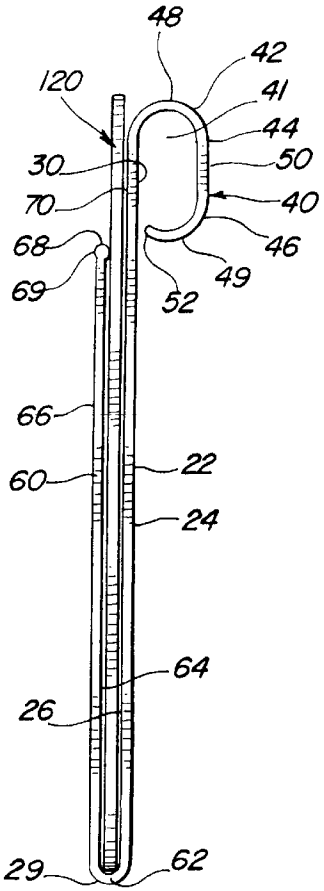
FIG. 6 is a side elevational view of the embodiment of FIG. 5, showing a credit card, or the like, received between the panels of the device.

FIGS. 5 and 6 illustrate a third embodiment of the device 10 wherein the top edge 68 terminates below the top surface 48 of the wall structure 42, leaving an upper portion 70 of the bottom surface 26 exposed. This allows a credit card 120 or other rigid card or flat article to be inserted in sandwiched relation between the panels 60, 22 so that a portion of the inserted article 120 is exposed and can be grasped with one's fingers to easily remove the article for use, as best seen in FIG. 6.

Figure 7:
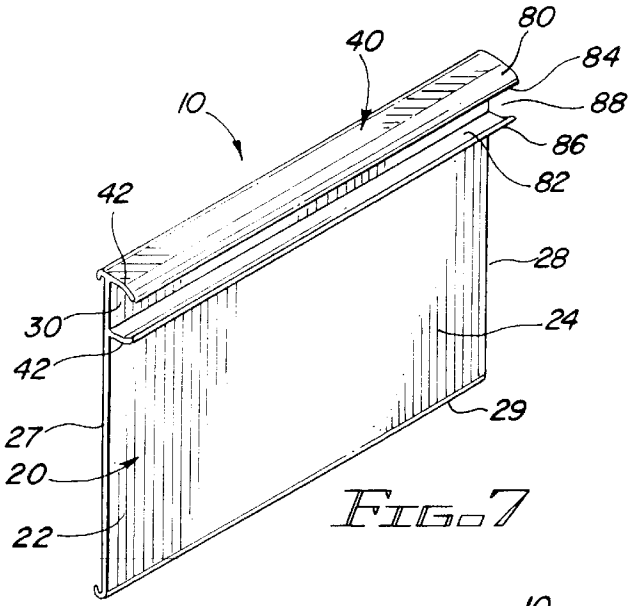
FIG. 7 is a top front perspective view of a fourth preferred embodiment of the present invention.
Figure 9:
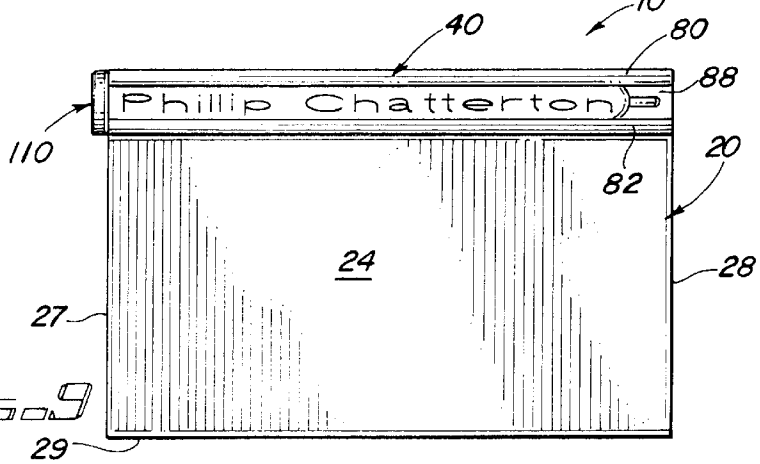
FIG. 9 is a front plan view of the embodiment of FIG. 7, showing a pen received within the article receptacle.
Figure 8:
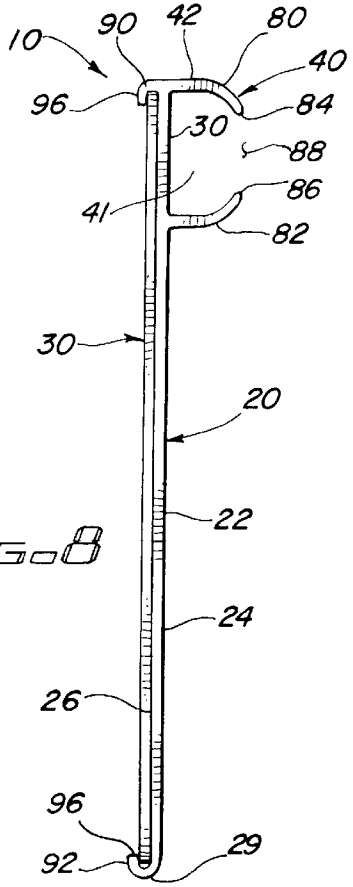
FIG. 8 is a side elevational view of the embodiment of FIG. 7, showing a credit card or the like received within the retaining track members on the bottom of the device.

FIGS. 7–9 illustrate a fourth embodiment of the device 10, wherein the wall structure 42 of the receptacle 40 is defined by a pair of opposing arcuate, longitudinal wall segments 80, 82 extending in parallel, spaced relation along the top peripheral edge zone 30. The wall segments 80, 82 curve upwards from the top surface 24 and towards one another, terminating at respective longitudinal free edges 84, 86 to leave an open gap 88 therebetween which partially exposes the channel 41. The wall segments 80, 82 are able to be urged outwardly, away from each other, to yield to an expansion force exerted by an article inserted within the channel 41. This allows the wall segments 80, 82 to grasp the article 110, applying sufficient pressure to the sides of the article in order to hold it in the captured position. The open gap 88 permits viewing of advertising indicia or other indicia on the article 100 when stowed in the receptacle 40, as seen in FIG. 9.

Another means to releasably capture articles on the base 20 is shown in FIGS. 7-9 and includes a pair of opposing track members 90, 92 extending along the bottom surface 26 of the primary panel 22 in spaced, parallel relation to one another. The track members 90, 92 each include a retaining lip 96 and are structured and disposed for sliding receipt of a flat, planar card or rigid sheet substrate 130 in captured relation therebetween so that the card is maintained against the bottom surface 26 by the retaining lips 96 in coplanar relation to the primary panel 22.

Referring to the embodiments of FIGS. 12-16, the receptacle 40 includes a hollow rectangular body 200 having a first end zone 202 with an open end 204, an opposite second end zone 206 and a channel 208 extending therebetween. The open end 204 and the channel 208 are sized and configured to receive and releasably capture the pen 110 therein. The receptacle 40 is defined by side walls 210, 212, top wall 214, and the top surface 24 of base 20 at the upper end zone 30. The receptacle 40 is integrally formed along the upper end zone 30 of the base 20 such that the side walls 210, 212 are disposed in substantially perpendicular relation to the top surface 24 of the base 20.

Figures 12, 13:
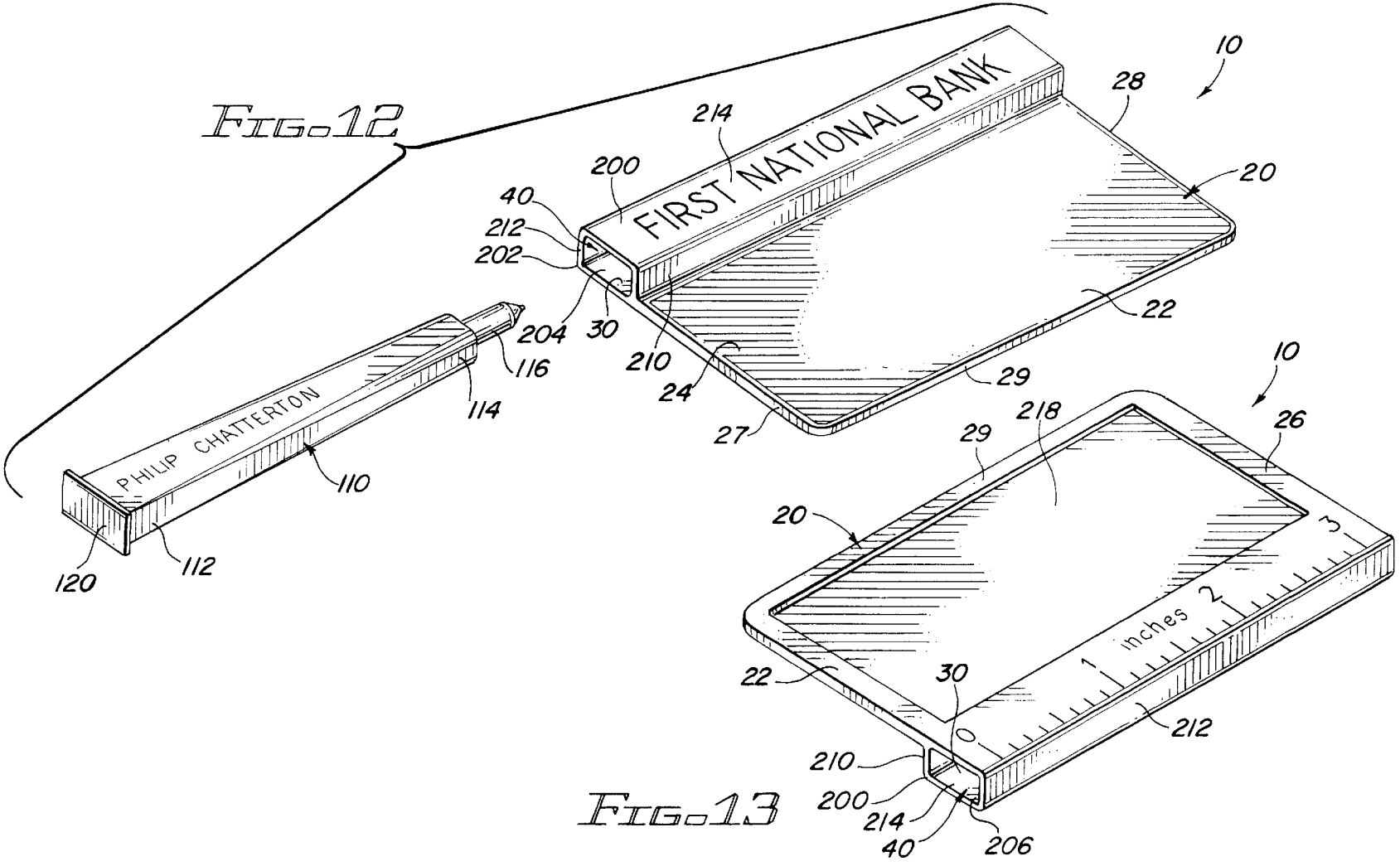
FIG. 12 is a top perspective view of a fifth preferred embodiment of the card device of the present invention.
FIG. 13 is a bottom perspective view of a sixth preferred embodiment of the card device showing a recessed area thereon.

The embodiment shown in FIG. 13 includes a recessed area 218 on the bottom 26 of the base 20 to accommodate one or more sheets of paper therein, such as a small pad. In a preferred embodiment, Post-It type note pads can be placed in the recessed area 218 and held therein by the adhesive on the paper.

The pen 110 includes a tapered rectangular body structured for releasable capture within the receptacle 40. The tapered rectangular body includes a wide end zone 112 and an opposite narrow end zone 114. The wide end zone 112 includes a wide end having outer dimensions which are slightly larger than the inner dimensions of the hollow rectangular channel 208 of the receptacle 40, thereby providing a frictional snug fit between the wide end zone 112 and the walls of the receptacle 40 so that the pen 110 may be releasably captured therein. The narrow end zone 114 includes a pen writing point 116 protruding therefrom.

The pen 110 may further include a flat plate or flange 120 formed on the wide end zone. The width and height of the flat plate 120 is slightly larger than the width and height of the open end 204 of the receptacle 40, thereby preventing the flat plate 120 from being inserted into the hollow rectangular channel 208 of the receptacle 40 and providing means for grasping the pen 110 when removing the pen from the receptacle 40.

Figure 14:
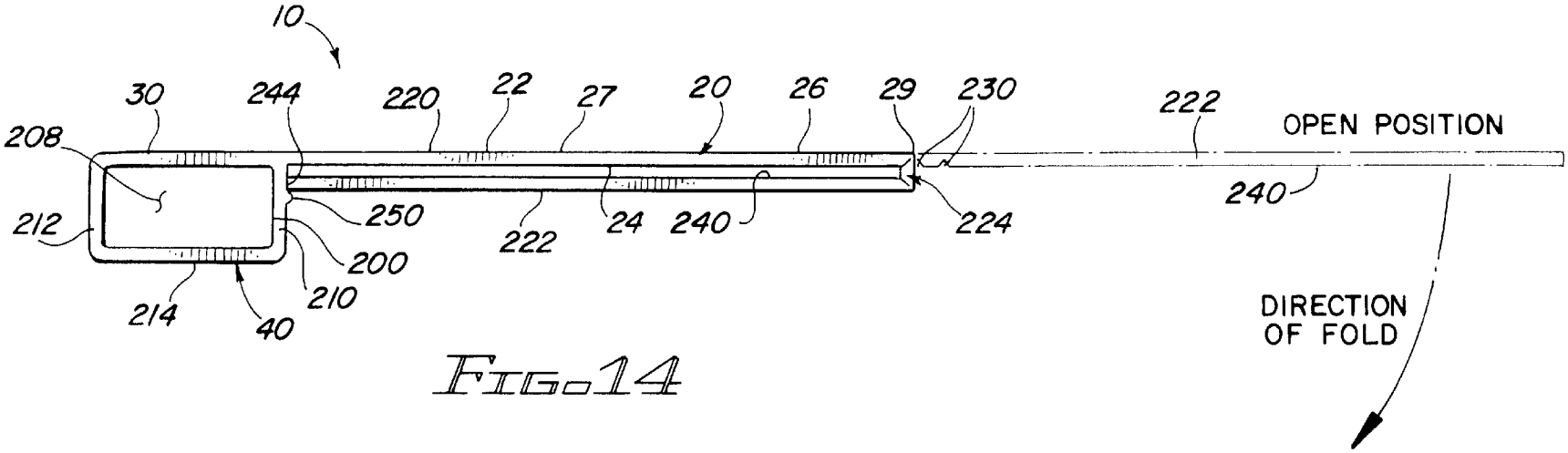
FIG. 14 is a side elevation of a seventh preferred embodiment of the card device, shown in partial phantom, illustrating movement of upper and lower portions of the base between an open, adjacent, coplanar position and a stacked orientation.

In the seventh preferred embodiment, as shown in FIGS. 14–15, the base 20 includes a first panel 220, a second panel 222, and hinge means 224 extending longitudinally between the first 220 and second 222 panels. The hinge means 224 is integrally formed between the panels 220, 222, and has grooves 230 of a reduced thickness to provide flexibility. The reduced thickness of the hinge means 224 permits a swinging movement of the panels 220, 222 relative to one another between an open, adjacent, coplanar position for writing thereon and a stacked position for receipt and storage in a credit card pocket or slot of a wallet or purse. In the embodiment shown in FIG. 15, the second panel 222 is folded beneath the first panel 220. The second panel 222 includes a bottom face 240 and two latching tabs 242 extending perpendicularly from the distal longitudinal edge 244 of the panel 222 such that the tabs 242 are disposed in substantially perpendicular relation to the bottom face 240 of the panel 222. Each tab 242 includes a latch 246 integrally formed at the distal end. The tabs 242 are structured and disposed so that the latches 246 will snap into recessed notches 246 located on the side wall 212 of the receptacle 40, thereby securing the second panel 222 to the base 20 in stacked position relative to the first panel 220.

Alternatively, in the embodiment shown in FIG. 14, the device 10 is structured and configured so that the second panel 222 is folded over the top surface 24 of the first panel 220 in the stacked position, thereby reducing the overall thickness of the device. In this instance, a rib 250 may be provided which protrudes out from the first side wall 210 of the receptacle 40. The rib 250 is structured to frictionally engage the distal longitudinal edge 244 of the lower portion as the distal edge is forced over the rib 250, thereby releasably capturing the second panel 222 in the stacked position.

Figure 16:
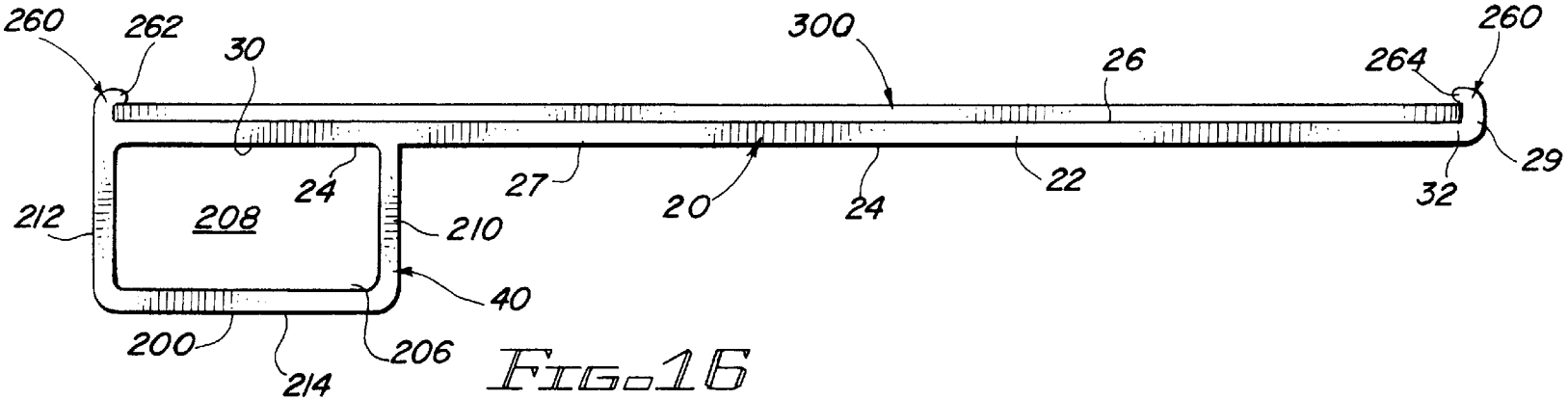
FIG. 16 is a side elevation of an eighth embodiment of the card device showing a track on the bottom thereof with a credit card held therein.

In an eighth embodiment as shown in FIG. 16, the base 20 further includes a track 260 having a first inwardly disposed lip 262 along the upper end zone 30 of the bottom surface 26 and an opposite second inwardly disposed lip 264 formed along the lower end zone 32 of the bottom surface 26 adjacent the bottom edge 29. The track is structured for sliding receipt of a credit card 300 therein so that the device 10 may carry a credit card 300, as well as the article 110 thereon.

Other than carrying a pen, the present invention may carry articles such as an eyeliner pencil, a nail file and other like articles. The present invention also serves numerous different functions in addition to carrying an article. For instance, the rigid base 20 may be used as a writing surface. Further, the base 20, receptacle 40, and article 110 provide means on which there can be printed advertising or other useful data or features such as a calendar, ruler or mirror. As illustrated in FIGS. 13 and 15, indicia may be included on the device 10 to provide measurement capabilities such as a scale or rule. Further, the base 20 may be manufactured to be a credit card, phone card or debit card.

The present invention can be utilized with a wide variety of devices including wallets, pursues or any other accessory which provides a space for a credit card. Further, the receptacle 40 may be open at both ends so that the article 110 may be inserted into either end of the receptacle 40. In many cases, the article 110 may be accessed from either an open or closed wallet.

While the instant invention has been described in accordance with what is considered to be preferred and practical embodiments thereof, it is recognized that departures may be made within the spirit of the invention which should not be limited in scope except as defined in the following claims and within the doctrine of equivalents.

Now that the invention has been described,

What is claimed is:

1. A device to be carried in a wallet or purse having credit card sized pockets or slots, said device comprising:

a base including a flat, rigid primary panel having a front surface, a rear surface, and surrounding peripheral edge zones, said base being sized and configured for removable receipt within the credit card sized pockets or slots of the wallet or purse so that when said base is received within said pockets or slots, one of said peripheral edge zones remains exposed exteriorly of the pocket or slot, an article having a generally elongate configuration, an external surface, a distal end portion and a proximal end portion, means for releasably grasping and capturing said article in a secured, stowed position on said base and including an article receptacle formed along said exposed one of said peripheral edge zones, said receptacle including a wall structure having a top longitudinal surface and a bottom longitudinal surface defining an elongate raised rail along said exposed one of said peripheral edge zones, said wall structure further defining a hollow elongate channel for receiving said article therein, said channel being structured and disposed for congruent, snug-fitted axial receipt of the article through either of said open ends so that the article is held in a captivated, fixed position relative to said receptacle when received therein, defining said stowed position, said receptacle being structured to expose said proximal end portion of the article when in said stowed position to enable grasping of the article for axial retrieval from the receptacle; and handle means for grasping said device to remove said base from within said pockets or slots.

2. A device as recited in claim 1 wherein said wall structure of said receptacle is defined by a rolled-over lip integral with said base and including a free elongate distal edge disposed in spaced relation to said front surface of said base and being yieldable to an expansion force exerted by said article when inserted within said channel.

3. A device as recited in claim 1 wherein said wall structure of said receptacle is defined by a pair of opposing arcuate longitudinal wall segments formed along said exposed one of said peripheral edge zones and curling upwards from said front surface of said panel and towards one another and terminating at free longitudinal edges in spaced relation to one another.

4. A device as recited in claim 1 wherein said base further includes a pair of opposing longitudinal track members extending along said rear surface of said primary panel in spaced, parallel relation to one another and being structured and disposed for sliding receipt of a flat planar card in captured relation therebetween so that said card is maintained in coplanar relation to said primary panel.

5. A device as recited in claim 1 wherein said base further includes a rigid back panel integrally formed with said rigid primary panel along a fold formed along one of said peripheral edge zones, said fold defining biasing means for urging said back panel towards said rear surface of said primary panel.

6. A device as recited in claim 5 where in said top longitudinal edge of said back panel is disposed between first and second parallel ones of said peripheral edge zones of said primary panel.

7. A device as recited in claim 5 wherein said back panel includes a top longitudinal edge disposed in close, spaced relation to said rear surface of said primary panel.

8. A device as recited in claim 7 wherein said top longitudinal edge of said back panel is substantially parallel with said top longitudinal surface of said wall structure on said primary panel.

9. A device as recited in claim 7 wherein said top longitudinal edge of said back panel is disposed between said top longitudinal surface of said wall structure on said primary panel and said fold.

10. A card device to be carried in a wallet or purse having credit card sized pockets or slots, said device comprising:

a base including a flat rectangular rigid panel having a top surface, a bottom surface and surrounding peripheral edge zones, said base being sized and configured for removable receipt within the credit card sized pockets or slots of the wallet or purse so that one of said peripheral edge zones is exposed exteriorly of said pockets or slots, an article having a generally elongate configuration, an external surface, a distal end portion and a proximal end portion, means formed along said exposed one of said peripheral edge zones for releasably grasping and capturing the article in a secured, stowed position along said exposed one of said peripheral edge zones and including a hollow body defining a receptacle, said receptacle including a first end zone having an open end, an opposite second end zone having an open end, and a channel extending therebetween, said channel being structured for snug-fitted axial receipt of the article from either of said open ends so that the article is held in a stationary position relative to said receptacle when received therein, defining said stowed position, and said receptacle further defining handle means for grasping said device to remove said base from within said pockets or slots.

11. A card device as recited in claim 10 further including holding means for releasably securing the article in said receptacle.

12. A card device as recited in claim 10 wherein said bottom surface of said base includes means for releasably retaining a credit card thereon.

13. A card device as recited in claim 10 wherein said base further includes a first panel, a second panel and hinge means therebetween for permitting swinging movement of said first and second panels relative to one another between a first position, wherein said first and second panels are disposed in stacked relation to one another and a second position, wherein said first and second panels are disposed in adjacent, coplanar relation to one another.

14. A card device as recited in claim 13 further including latching means for securing said second panel to said base when in said first position.

* * * * *